US005616019A

United States Patent [19]

Hattori et al.

[11] Patent Number: 5,616,019

[45] Date of Patent: Apr. 1, 1997

[54] ROLLING PISTON TYPE EXPANSION MACHINE

[75] Inventors: Hitoshi Hattori; Motonori Futamura; Kazuo Saito; Masao Ozu, all of Kanagawa-ken, Japan

[73] Assignee: Kabushiki Kaisha Toshiba, Kawasaki, Japan

[21] Appl. No.: 534,983

[22] Filed: Sep. 27, 1995

[30] Foreign Application Priority Data

Jun. 13, 1995 [JP] Japan ..... 7-146580

[51] Int. Cl.[6] ..... F01C 1/02

[52] U.S. Cl. ..... 418/66; 418/67; 418/188

[58] Field of Search ..... 418/60, 66, 67, 418/188

[56] References Cited

U.S. PATENT DOCUMENTS

| | | | |
|---|---|---|---|
| 1,923,291 | 8/1933 | Zimmerer | 418/66 |
| 3,269,646 | 8/1966 | August | 418/66 |
| 5,322,424 | 6/1994 | Fujio | 418/60 |

FOREIGN PATENT DOCUMENTS

| | | | |
|---|---|---|---|
| 98064 | 11/1922 | Germany | 418/66 |
| 223289 | 7/1988 | Japan | 418/67 |
| 138392 | 5/1989 | Japan | 418/188 |

*Primary Examiner*—Charles G. Freay
*Attorney, Agent, or Firm*—Foley & Lardner

[57] ABSTRACT

A rolling piston type expansion machine eliminates the need for an open-close valve mechanism and smoothens the timing of inflow of high-pressure gas. The machine includes a cylinder having a discharge port and a roller freely gyratable or orbital in the cylinder. A freely movable blade supported in the cylinder has its tip in contact with the circumferential surface of the roller to form an expansion chamber. A gas passage is freely rotatably supported by a main bearing member and a secondary bearing member. The gas passage is formed in a main shaft having a crank shaft portion that gyrates or orbits the roller. An inlet port is provided along a shaft center of the main shaft. An inflow timing control portion controls inflow timing of the suction gas toward the expansion chamber via the inlet port of the gas passage.

9 Claims, 8 Drawing Sheets

ROLLING PISTON TYPE EXPANSION MACHINE

BACKGROUND OF THE INVENTION

1. Technical Field

The present invention relates to a rolling piston type expansion machine most suitable for a Rankine cycle machinery.

2. Background Art

Generally, a Rankine cycle machinery performs an opposite operation to the cooling cycle. The Rankine cycle machinery is a heat engine where heat is obtained from a high-temperature heat source, and its part of the obtained heat is transformed to a work, so that excess heat therefrom is made low-temperature so as to be discharged. Thus the Rankine cycle machinery uses the work as a power source for compression. Outline of operation thereof is described as follows. High-pressure gas is supplied to an expansion chamber from a suction port, and power due to expansion work is generated so as to become low-pressure gas. Thereafter, the low-pressure gas, which completed the expansion work, is discharged from a discharge port. Timing at which the high-pressure gas is supplied to the expansion chamber, and timing at which the low-pressure gas is discharged are controlled by an open-close valve mechanism.

In the conventional expansion machine, there is necessitated the open-close valve in order to supply the high-pressure gas and discharge the low-pressure gas. Thereby, there are caused disadvantageous aspects in terms of assembly and installation of the open-close valve, and cost performance and increased amount of parts therefor.

SUMMARY OF THE INVENTION

In view of the foregoing drawbacks, it is therefore an object of the present invention to provide a rolling piston type expansion machine where an open-close valve mechanism is eliminated and where the timing for suction of high-pressure gas is smoothed up.

To achieve the object, there is provided a rolling piston type expansion machine comprising: a cylinder having a discharge port therein; a roller freely eccentrically rotatable or orbital in the cylinder; a blade freely movably supported by the cylinder and whose tip is in contact with the circumferential surface of the roller so as to form an expansion chamber; a gas passage which is freely rotatably supported by a main bearing member and a secondary bearing member, and which includes a main shaft having a crank shaft portion that causes eccentric rotation to the roller, and which includes a suction port provided along a shaft center of the main shaft; and an inflow timing control means for controlling inflow timing of the suction gas toward the expansion chamber via the suction port of the gas passage.

As a preferable embodiment, the inflow timing control means includes: a roller inflow inlet provided in the roller and connected to the expansion chamber; and a crank shaft inflow inlet which is provided in the crank shaft portion and constantly connected to the suction port of the gas passage and is intermittently connected to the roller inflow inlet by the rotation of the crank shaft portion.

As a preferable embodiment, there is provided a ditch in the circumferential surface of the roller, so that a tip of the blade is engaged with the ditch so as to prevent automatic operation of the roller. Alternatively, a tip of the blade may be integrally made into the circumference of the roller so that the rotating motion of the roller about its axis is prevented.

Moreover, as a means for making the blade and the roller as an integrated unit, the roller and the blade are made of different material and integrally made by a press-fitting process or the like, or they can be made of the same material and made as a single unit.

Moreover, the rolling piston type expansion machine is characterized in that the roller performs revolving motion without rotation, while in contact with the inner surface of the cylinder.

Thereby, according to the rolling piston type expansion machine of the present invention, the roller performs an eccentric motion without accompanying the rotation by the fact that at the outset the rotating power is supplied to the crank shaft portion via the main shaft. In response to this eccentric motion of the roller without accompanying the rotation, the crank shaft inflow inlet and the roller inflow inlet become connected through per single rotation of the crank shaft portion, so that the high-pressure gas from the gas passage is intermittently supplied to the expansion chamber. The low-pressure gas that completed expansion work at the expansion chamber is discharged externally from the cylinder through the discharge port. This operation is repeated. Therefore, even without the conventional open-close valve mechanism, supply of the high-pressure gas and the discharge of the low-pressure gas can be smoothly performed in the present invention. Namely, the timing at which the high-pressure gas is sucked is smoothly done so that the expansion work can be effectively carried out.

BRIEF DESCRIPTION OF THE DRAWINGS

These and other objects, features and advantages of the present invention will become more apparent from the following description of the preferred embodiment taken in conjunction with the accompanying drawings, in which.

DETAILED DESCRIPTION OF THE PREFERRED EMBODIMENTS

Features of the present invention will become apparent in the course of the following description of exemplary embodiments given for illustration of the invention and are not intended to be limiting thereof.

Embodiments of the present invention will now be described with reference to FIG. 1—FIGS. 10A and 10B.

Figure 1:
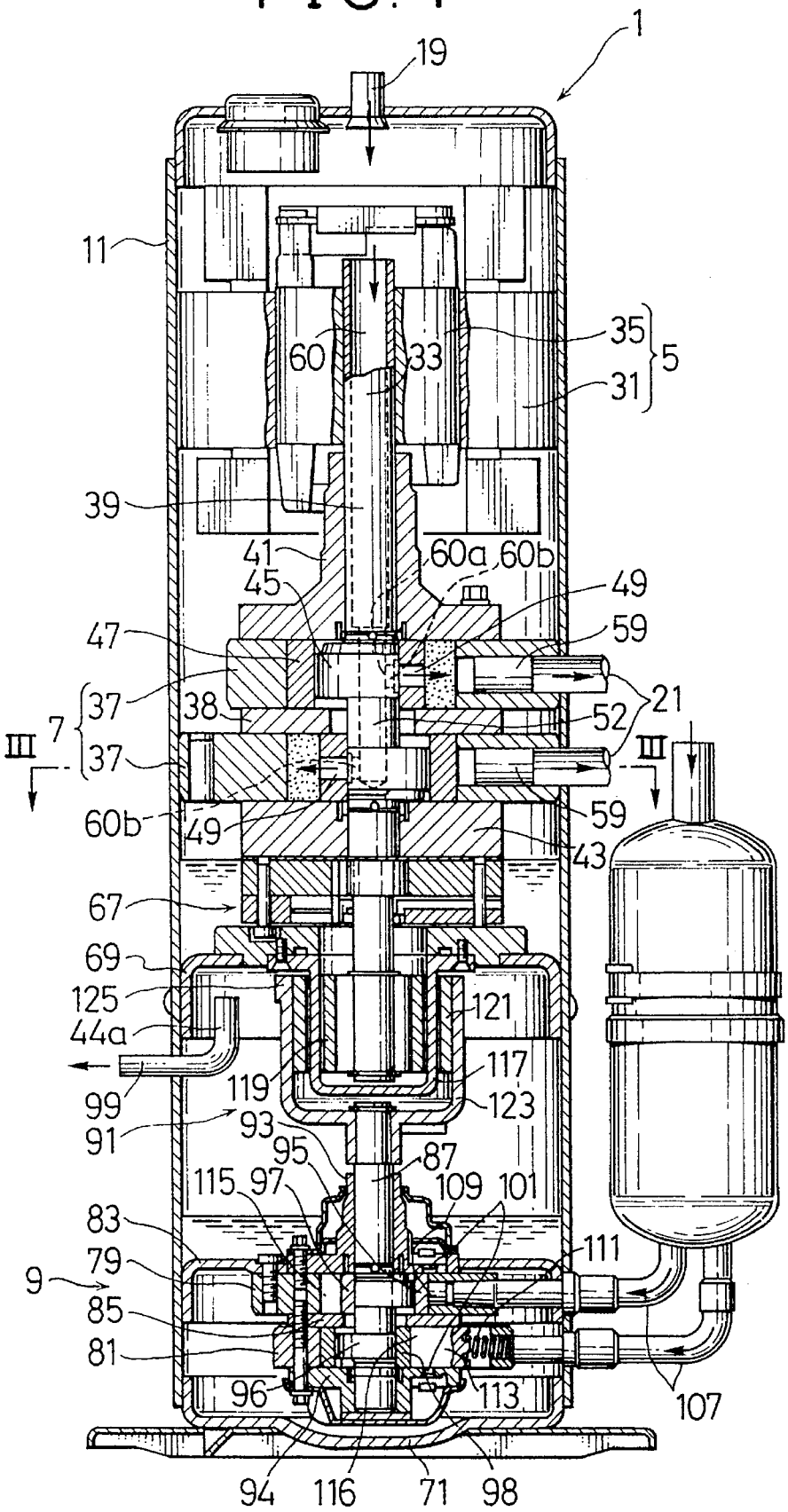
FIG. 1 shows a brief cross section of a rolling piston type expansion machine according to the present invention.

FIG. 1 is an overview of a rolling piston type expansion machine 1 according to an embodiment for the present invention.

Figure 2:
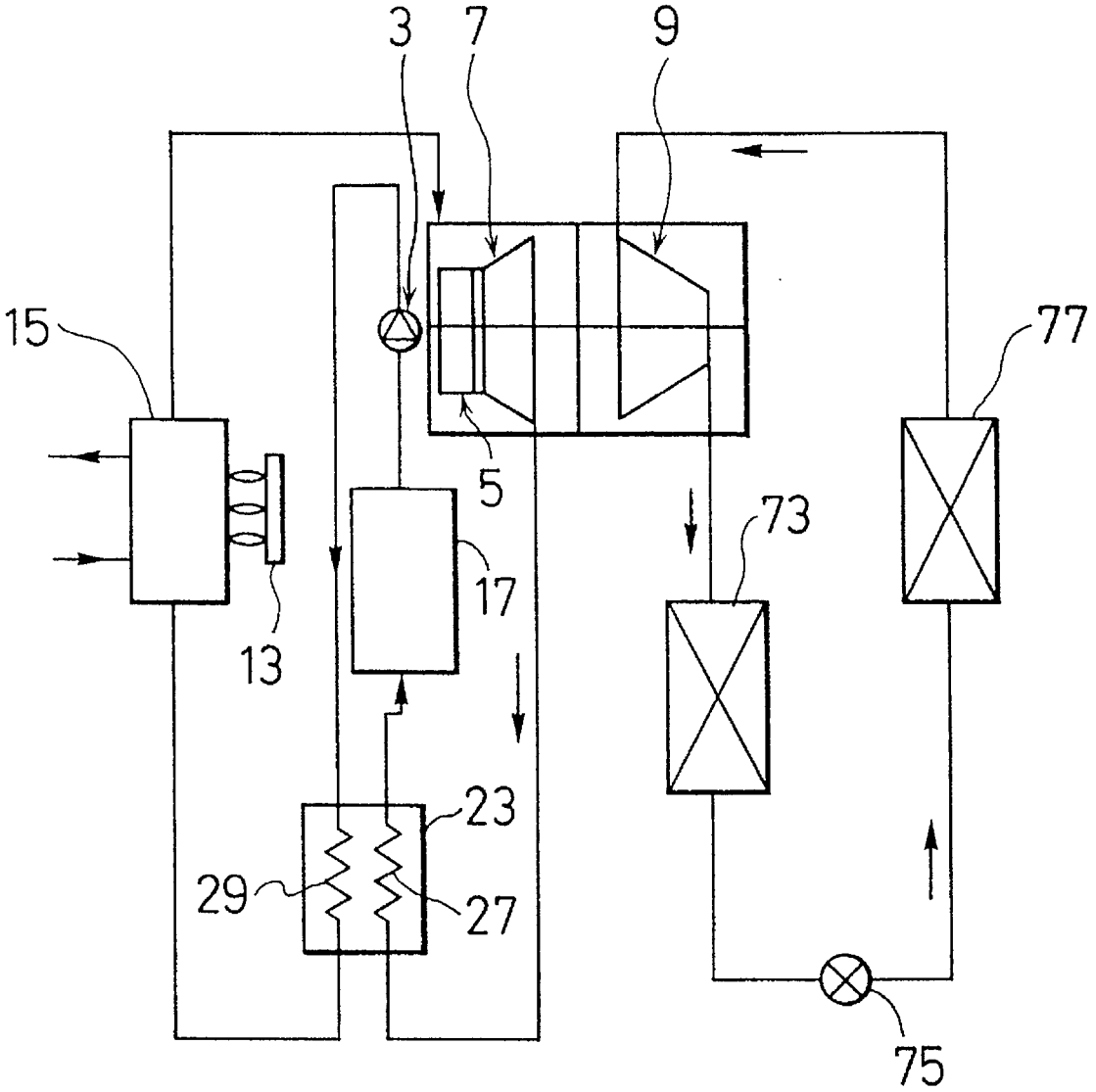
FIG. 2 shows a configuration diagram showing an example of a Rankine cycle machinery using a rolling piston type expansion machine according to the present invention.

A rolling piston type rotating machine 1 has a driving motor 5, an expansion machine 17, a compression machine 9 placed in order from the upper side of the rolling piston type rotating machine. The driving motor 5 and the expansion machine 7 are contained in an upper closed-type case 11. As shown in FIG. 2, the Rankine cycle machinery comprises a steam generator 15 in which an operation gas is changed to a high temperature and high pressure gas by supplying heat from a heat source such as a burner 13, the expansion machine 7 generating a power by it's expansion work, and an compression equipment 17 liquefying the operation gas, which is heat-exchanged with air through a fin, and a circulation pump 3 circulating the operation gas.

The circulation circuit comprises a gas introduction pipe 19 through which the operation gas is introduced and a gas transmission pipe 21 for transmissing the operation gas. The gas introduction pipe 19 is connected to the compression equipment 17, the gas transmission pipe 21 is connected to the input side of the steam generator 15 through a recovery heat exchanger 23. In this case, by providing a rotating power to the pump 3, the liquefied operation gas by the compression equipment 17 is transmitted to the steam generator 15.

The recovery heat exchanger 23 comprises a first heat exchanger pipe 27 and a second heat exchanger 29. One side of the first heat exchanger pipe 27 is connected to the discharge side of the expansion machine 7, the other side of the first heat exchanger pipe 27 is connected to the introduction side of the compression equipment 17. In addition, one side of the second heat exchanger pipe 29 is connected to the introduction side of the steam generator 15 and the other side of the second heat exchanger pipe 29 to the discharge side of the compression equipment 17. By this configuration, the heat in the operation gas, which has perform the expansion work in the expansion machine 7, is recovered. The recovered heat is transmitted to the steam generator 15.

The driving motor 5 comprises a stator 31 and a rotor 35 fixed on a motor shaft 33. The stator 31 is fixed to the inside wall of the upper closed-type case 11. By flowing a current in the stator 31, a rotating power is given to the motor shaft 33 through the rotor 35.

The expansion machine 7 has a cylinder 37. The cylinder 37 is fixed in the inside wall of the upper closed-type case 11 and a main shaft 39 penetrates the cylinder 37.

The main shaft 39 of the expansion machine 7 and the motor shaft 33 of the driving motor 5 are integrated into one shaft. The shaft 33/39 is rotatably supported by a main bearing member 41 and an auxiliary bearing member 43. An eccentric shaft portion 45 is located on a part of the main shaft 39 corresponding to the position of the cylinder 37. A roller 47 is placed in the cylinder 37 and is placed and integrated in the eccentric shaft portion 45. Thereby, the eccentricity rotation power is provided to the roller 47 when the eccentricity shaft portion 45 rotates.

Figure 3:
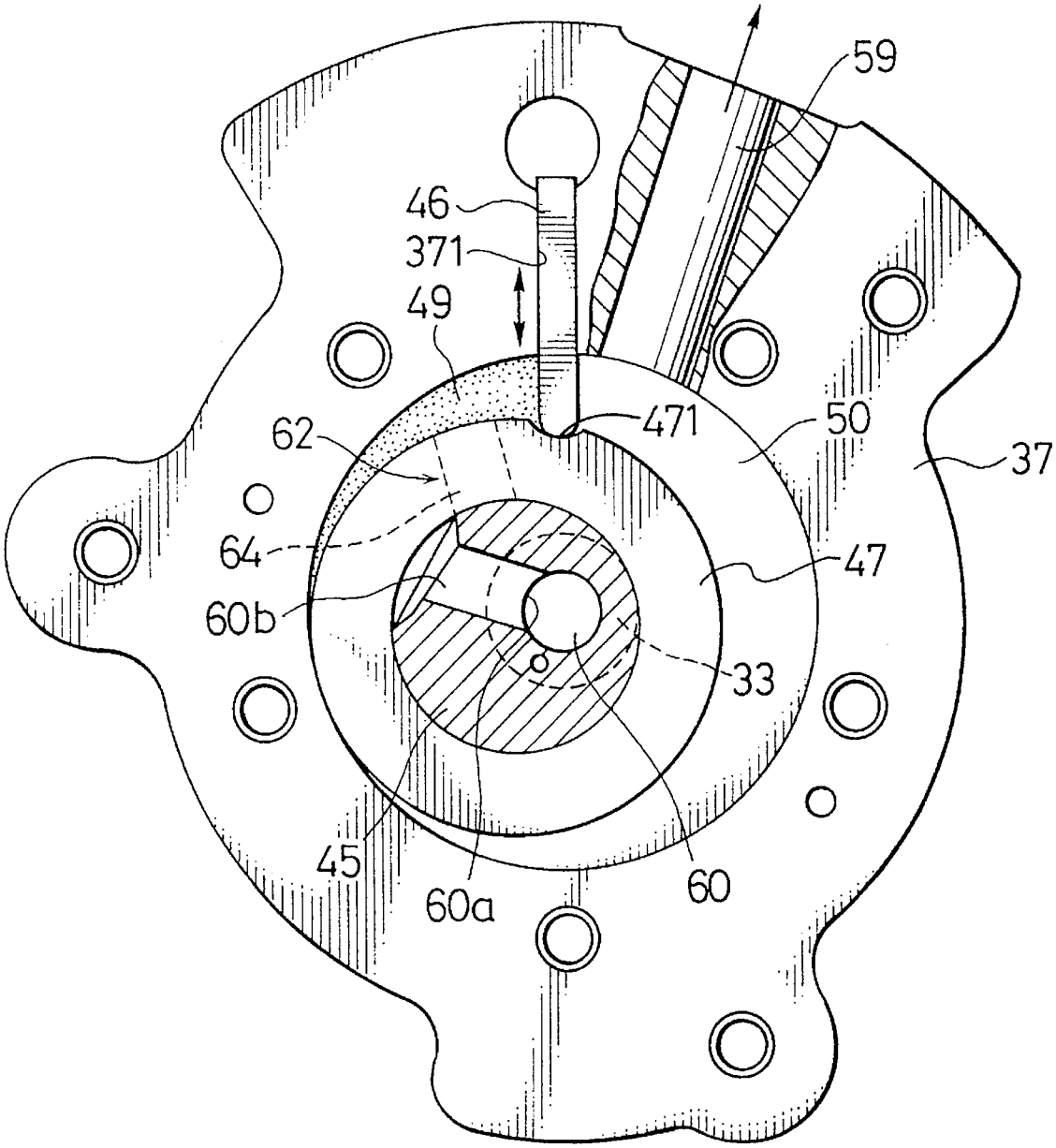
FIG. 3 shows a cross section of the rolling piston type expansion machine taken along with line 3—3 shown in FIG. 1.
Figure 4:
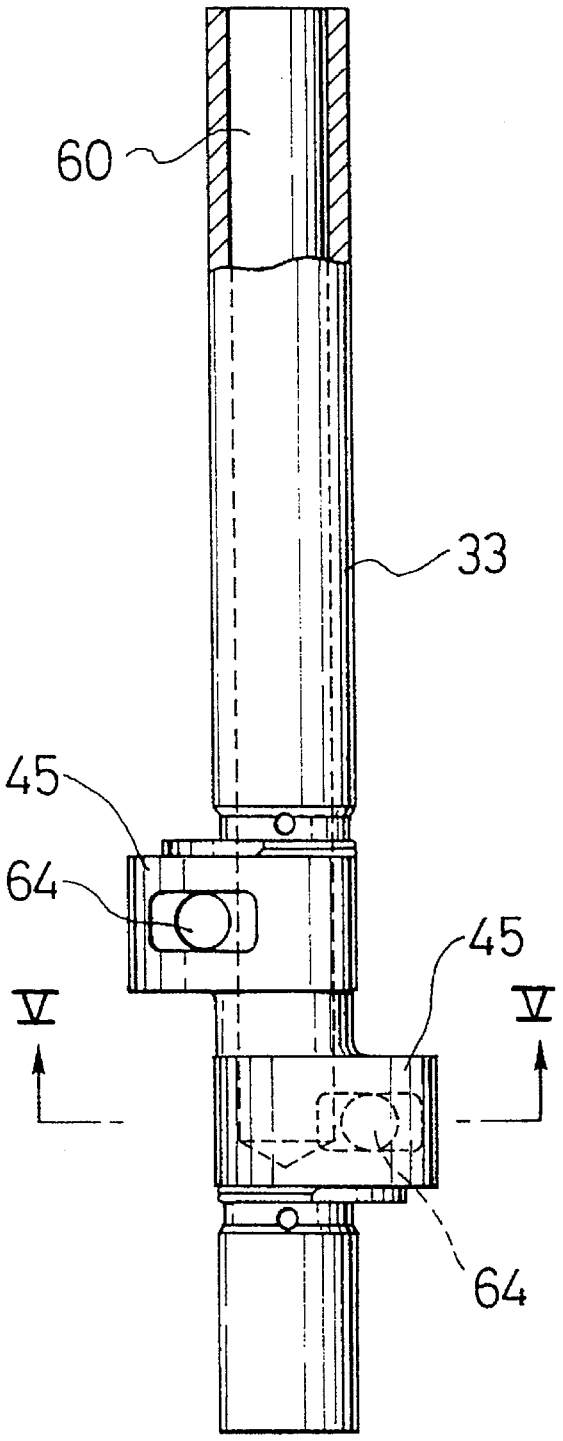
FIG. 4 shows a cross section of a main shaft of the rolling piston type expansion machine shown in FIG. 1.
Figure 5:
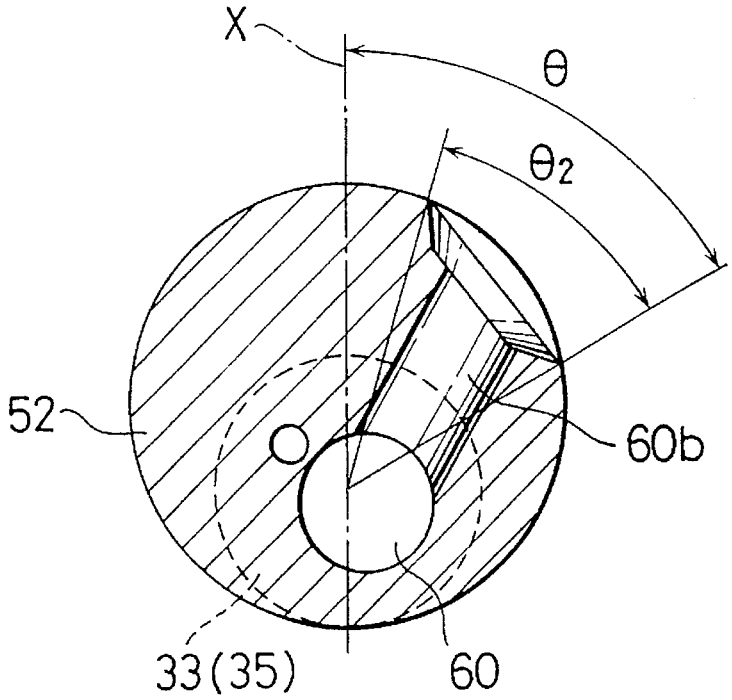
FIG. 5 shows an enlarged cross section of the main shaft shown in FIG. 4.
Figure 6:
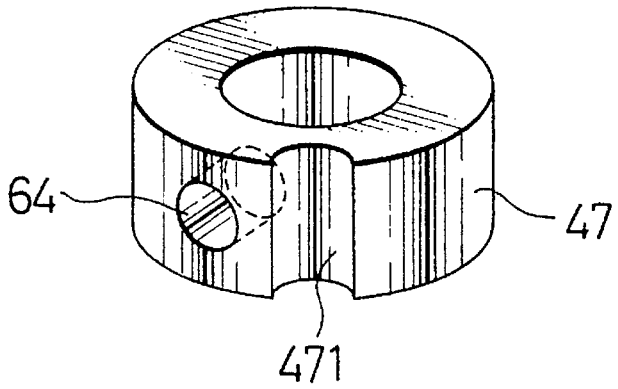
FIG. 6 shows a perspective view of a roller for the rolling piston type expansion machine shown in FIG. 1.

Referring to FIG. 3, there is provided a ditch 471 in a peripheral surface of the roller 47. A tip of the blade 46, which is freely movable in the arrow direction (see FIG. 3, is positioned against a blade support portion 371 of the cylinder 37, and the blade 46 is constantly activated toward a side of the roller 47 by an activating means such as back pressure. Similarly, there is provided the blade 46 in other side of roller 47.

Thereby, an expansion chamber 49 and a discharge chamber 50 are formed and provided by means of blade 46, and a decentering rotation whose phase is displaced by 180° is given to each roller 47, 47 where rotation by each roller 47, 47 itself is not accompanied.

Figure 8A:
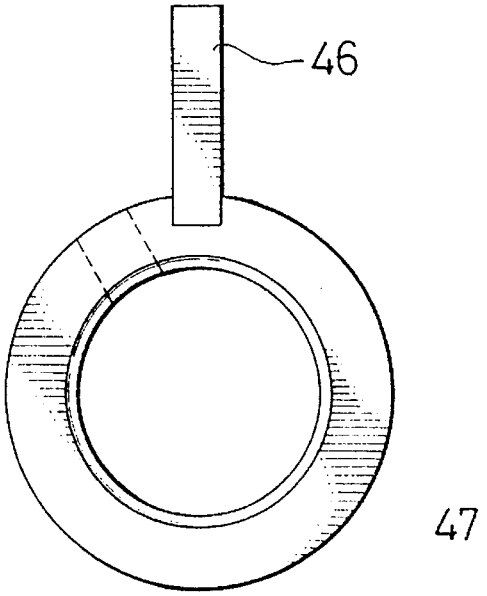
FIG. 8A and FIG. 8B illustrate where a blade is press-fit to the roller.
Figure 8B:
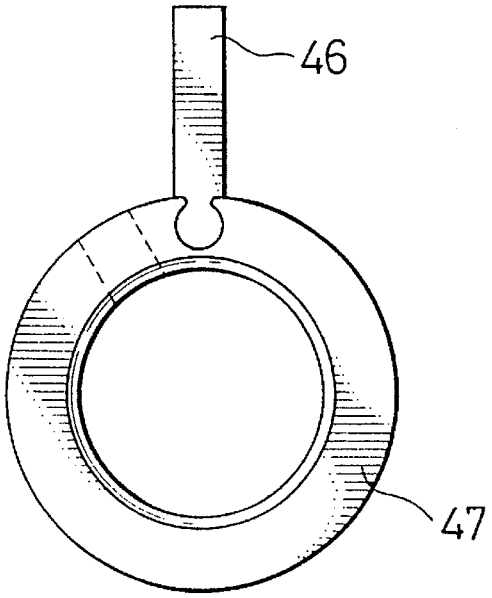

The blade 46 that forms and provides the expansion chamber 49 and the discharge chamber 50 may be such that the blade 46 and roller 47 are formed integrally by press-fitting the blade 46 to the circumferential surface of the roller 47 as illustrated in FIG. 8A and FIG. 8B.

Figure 9:
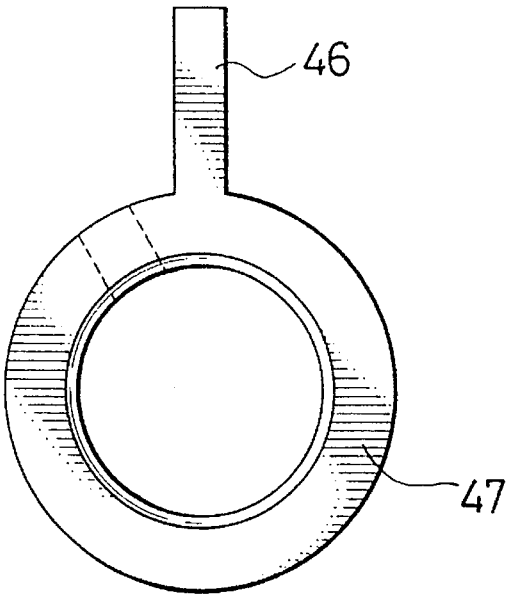
FIG. 9 illustrates that the blade is formed and integrated into the roller.
Figure 10A:
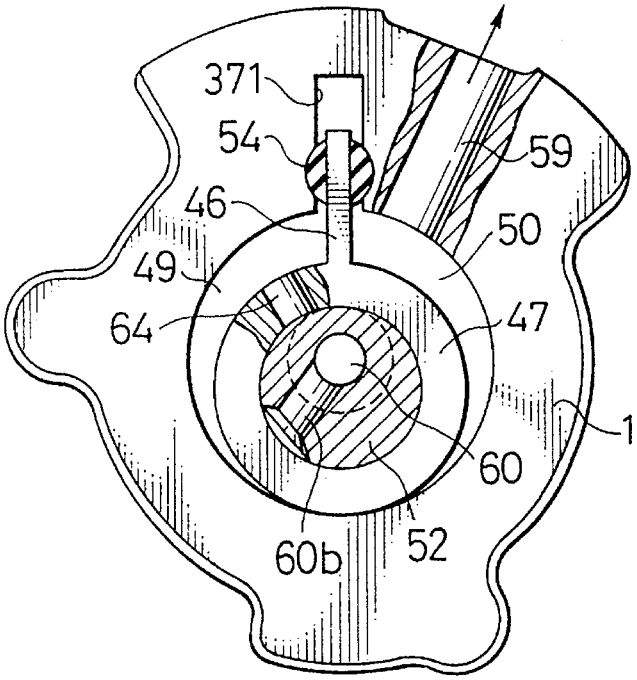
FIG. 10A and FIG. 10B illustrate that the blade integrated to the roller is provided to a cylinder.
Figure 10B:
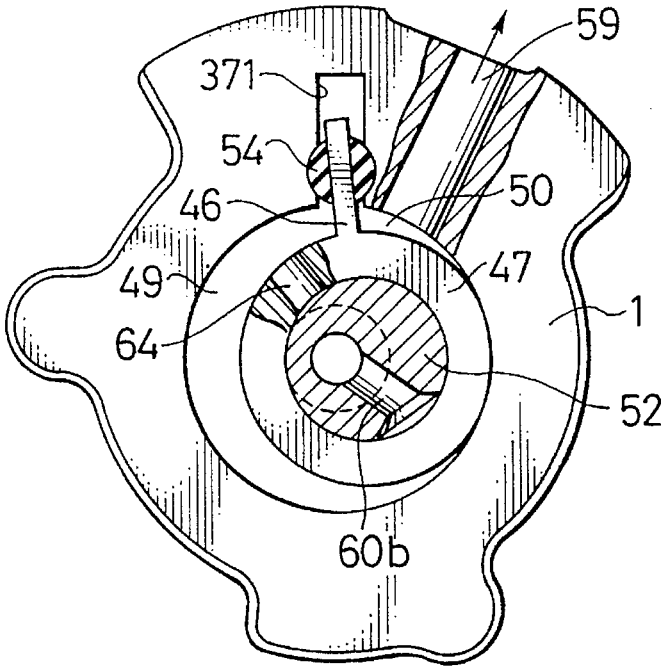

Referring to FIG. 9, the blade 46 and the roller 47 may be in the integral form where the blade 46 rises up from the roller 47. In these types where the roller 47 and the blade 46 are integrally formed, it is preferable that in the blade support portion 371 an oscillating bush 54 be provided, which permits the motion of the blade accompanied by the decentering rotation or gyrating or oscillating of the roller 47 and which is made of sliding material, as illustrated in FIG. 10A and FIG. 10B The discharge chamber 50 is connected to the discharge port 59 provided in the cylinder 37. The expansion chamber 49 is connected via inflow timing control means 62 to a gas passage 60 where high-pressure gas flows. The gas passage 60 is provided along the shaft center direction of the main shaft 33/39.

One end of the gas passage 60 is an in-take inlet for the high-pressure gas, while the other end of the gas passage 60 is constantly connected and communicated to a crank shaft inflow inlet **60*b*, which serves as the inflow timing control means 62, via the suction port 60*a***.

The crank shaft inflow inlet **60*b* is provided so that it is orthogonal to the shaft center of the crank shaft portion 52. Moreover, with reference to FIG. 5, in angle θ (representing use condition) provided from a datum line X passing through the main shaft 33 and the center of the crank shaft portion 52, an inlet angle θ2 for the crank shaft inflow inlet 60*b*** is set so as to obtain a predetermined expansion ratio.

The crank shaft inflow inlet **60*b* is connected to the expansion chamber 49 via a roller inflow inlet 62 provided in each roller 47, 47**.

The roller inflow inlet 62 gets connected by a single rotation of the crank shaft inflow inlet **60*b*, so that the high-pressure gas from the gas passage 60 is supplied intermittently to the expansion chamber 49 via the roller inflow inlet 64**.

Figure 7:
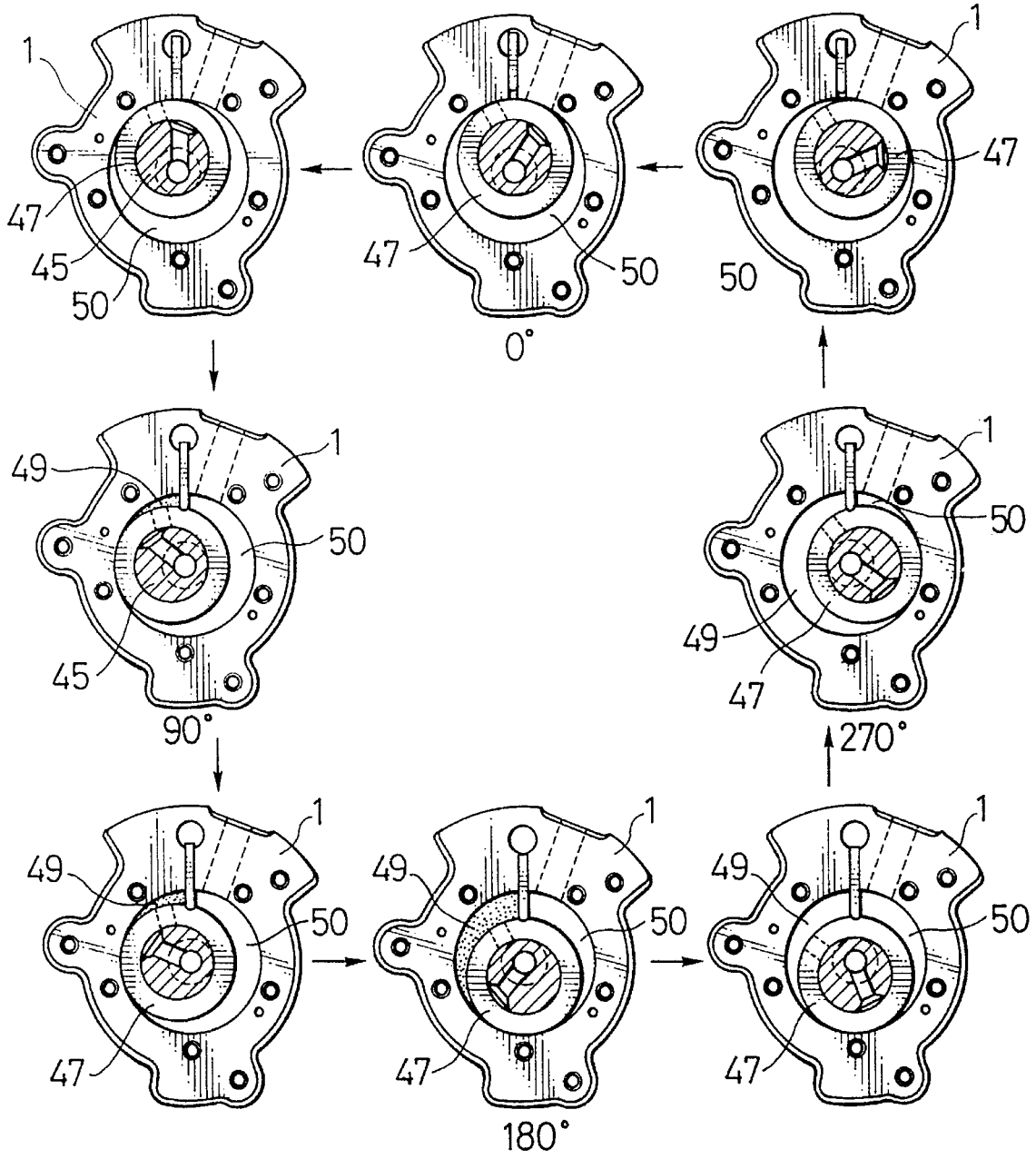
FIG. 7 illustrates operations of the rolling piston type expansion machine shown in FIG. 1.

In thus constructed rolling piston type expansion machine 1, after the rotation power is provided to the main shaft 33/39 by the auxiliary motor 5 upon being electrically energized, the auxiliary motor 5 is switched off. Then, in the expansion machine 7, the high-pressure gas is fed from the gas passage 60. Thereby, the main shaft 33/39 is rotated, so that a suction process is started and then completed and the expansion process is started so as to perform the expansion work, in response to the rotation angle of the crank shaft portion 52 as shown in FIG. 7. Thereafter, the gas becomes the low-pressure gas at the time of completion of the expansion, so as to be discharged from the discharge port 59. These operations described in this paragraph are repeated.

During operation of the expansion machine 7, the high-pressure gas is supplied to the expansion chamber 49 via the crank shaft inflow inlet **60*b* and the roller inflow inlet 64**.

Therefore, there is not caused any major inflow resistance. Moreover, since a dead capacity is limited to a volume of the roller inflow inlet 64, the effect of the dead capacity can be minimized, so that there can be obtained a significantly large output of the expansion machine. Moreover, the roller 47 produces a grating or orbiting motion in contact with the inner surface of the cylinder 37, so that the effect of seal leakage is not caused, thus realizing a significantly high efficiency of the expansion machine.

Though the expansion machine is described as a twin type where there are provided cylinders 37, 37 in both sides of the intermediate partition plate 38 in the above embodiment, a similar advantageous result can be obtained with a single type expansion machine having a single cylinder.

The compression machine 9 is contained in a lower side closed-type case 71. As shown in FIG. 2, the cooling cycle comprises the compressor 73, an expansion valve for using the expansion of the operation gas, the steam generator 77 for exchanging the air through the fin to a cooling air by the heat exchange.

The compression machine 9 comprising a first cylinder 79 and a second cylinder 81 fixed and supported by an supporting frame 83 fixed in the inside wall of the closed-type case 71.

The first and second cylinders 79 and 81 are separated independently by an intermediate plate 85 through which the main shaft 87 is placed.

The main shaft 87 of the compression machine 9 is connected to the main shafts 39 extended from the expansion machine 7 through the magnet coupling 91. The main shaft 87 is supported rotatably by the main bearing 93 and the auxiliary bearing 94.

In the main shaft 87, the eccentric shaft portions 95 and 96 are shifted by 180 degree in phase at the portions corresponding to the first and second cylinders 79 and 82 respectively.

These eccentric shafts 95 and 96 are connected to the first and second rollers 97 and 98 placed in the first and second cylinders 79 and 81 respectively.

Thereby, the eccentricity rotation power, which is shifted by 180 degree in phase from the rotation of the eccentricity shaft portions 95 and 96, is provided to each of the rollers 97 and 98.

An outlet port 101, which is connected to an outlet pipe 99, is provided to the main bearing 93 and the auxiliary bearing 94. The inflow inlet side of the outlet pipe 99 is placed between the supporting frame 69 and the magnet coupling 91. The inflow inlet of the outlet pipe 99 is directed to the upper side to prevent drawing of a lubricating oil.

In this case, it may be acceptable to have a configuration in which the inflow inlet side 99*a* of the outlet pipe 99 is placed in the reversing direction to the rotating direction of the magnet coupling 91.

In addition, in the first and second cylinders 79 and 81, inflow inlet ports 109, 109 connected to the inflow inlet pipe 107, the blade 113 connected to the outside wall of the first and second rollers 97 and 98 by a pressing means such as a back pressure and a spring are provided. The compressing chambers 115 and 116 are made by the rollers 97, 98 and the blade 113.

The magnet coupling 91 is supported by the supporting frame 69 in integration. The magnet coupling 91 comprises a magnet 119 located at the compression machine 9 side placed through a bulkhead having a large electric resistance and a magnet 121 located at the expansion machine 121. The magnet 119 at the compression machine 9 side is placed in the inside of a yoke portion having a U-figure shape placed on the main shaft 87.

The magnet 119 at the expansion machine 7 side is placed on the main shaft 3 expanded from the high pressure pump 67. When the inside magnet 119 is rotating, the outside magnet 121 has a rotating power by the magnetic force. Thereby, the rotating power is transmitted to the main shaft 87 of the compression machine 9 side from the main shaft 33/39 of the high pressure pump 67.

On the other hand, a balancer 125 is provided at the yoke portion 123 having the U-figure shape for eliminating an unbalance state of the compression machine 9. However, the position of the balancer 125 is not fixed. A position of the balancer 125 must be located at a most suitable position for a respective condition.

A material having a large electric resistance (for decreasing an eddy current loss) and a large machine strength (tensile strength) can be used for the bulkhead 117. For example, a Hastelloyds alloy is the most acceptable for the bulkhead 117, but a carbon steel, a chromium, and a molybdenum steel may be used.

As have been described so far, by employing the rolling piston type expansion machine according to the present invention, the open-close valve mechanism is eliminated, so that the number of parts is significantly reduced and the construction realized thereby is desirable in terms of ease of assemblage and overall cost performance.

Moreover, according to the construction realized the rolling piston type expansion machine of the present invention, the detrimental effect of the dead capacity and inflow resistance caused by the open-close valve mechanism found in the conventional expansion machine is minimized, so that the output of the expansion machine can be significantly increased. Moreover, the high-pressure gas is supplied to the expansion chamber comprised of the roller that makes the decentering and revolving or gyrating or orbiting motions in the cylinder without accompanying the rotation. As a result, the seal leakage is not caused, thus achieving overall high functional efficiency of the expansion machine. Thereby, efficient expansion work is performed by smoothing up the timing the suction of the high-pressure gas.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A rolling piston type expansion machine comprising:

a cylinder having a discharge port therein;

a crank shaft portion located within the cylinder;

a roller located within the cylinder and coaxially supported by the crank shaft;

a blade movably supported by the cylinder and contacting the roller to prevent the roller from rotating around an axis of the roller and forming an expansion chamber;

a main shaft eccentrically supported by the crank shaft with an axis of the main shaft displaced from an axis of the crank shaft;

a gas passage formed through the main shaft in an axial direction of the main shaft;

a roller inflow inlet extending in the roller; and a crank shaft inflow extending in the crank shaft to communicate working gas between the roller inflow inlet and the gas passage, wherein the working gas is intermittently supplied to the expansion chamber in synchronism with rotation of the main shaft.

2. The rolling piston type expansion machine of claim 1, wherein the circumferential surface of the roller is provided with a ditch and a tip of the blade contacts the ditch to prevent the roller from rotating around the axis of the roller.

3. The rolling piston type expansion machine of claims 1, wherein there is provided a ditch in the circumferential surface of the roller, so that a tip of the blade is engaged with the ditch so as to prevent automatic operation of the roller.

4. The rolling piston type expansion machine of claims 1, wherein a tip of the blade is integral the roller so that the rotating motion of the roller is prevented.

5. The rolling piston type expansion machine of claim 1, wherein the roller and the blade are made of different materials and are integrated by a press-fit.

6. The rolling piston type expansion machine of claims 1, wherein the roller and the blade are made of same material and are unitary.

7. The rolling piston type expansion machine of claims 1, wherein the roller orbits without rotation, while in contact with an inner surface of the cylinder.

8. The rolling piston type expansion machine of claims 1, wherein there are provided a pair of the cylinders, rollers, blades, gas passages and crank shafts, thus being of a twin type.

9. The rolling piston type expansion machine of claims 1, wherein there is provided a single unit of the cylinder, roller, blade, gas passage and crank shaft, thus being of a single type.

* * * * *